US008671598B2

(12) United States Patent
Murphy et al.

(10) Patent No.: US 8,671,598 B2
(45) Date of Patent: Mar. 18, 2014

(54) WALL MOUNTED IRONING BOARD CABINET

(75) Inventors: Loretta Murphy, Tulsa, OK (US); John Sames, Tulsa, OK (US); Baldemar Elizondo, Broken Arrow, OK (US); Crayton José Long, Tulsa, OK (US)

(73) Assignee: C&A International, LLC

( * ) Notice: Subject to any disclaimer, the term of this patent is extended or adjusted under 35 U.S.C. 154(b) by 78 days.

(21) Appl. No.: 13/330,951

(22) Filed: Dec. 20, 2011

(65) Prior Publication Data

US 2013/0154459 A1 Jun. 20, 2013

(51) Int. Cl.
*D06F 81/06* (2006.01)
*D06F 81/02* (2006.01)

(52) U.S. Cl.
USPC ..... 38/104; 108/42

(58) Field of Classification Search
USPC ..... 38/104, 137, 139; 312/237, 242; 108/37, 39, 42, 47, 48
See application file for complete search history.

(56) References Cited

U.S. PATENT DOCUMENTS

| | | | | | |
|---|---|---|---|---|---|
| 920,343 | A | | 5/1909 | Kelly et al. | |
| 960,213 | A | * | 5/1910 | Williams | 108/48 |
| 1,207,268 | A | | 12/1916 | Blanchard | |
| 1,560,962 | A | * | 11/1925 | Agee | 108/37 |
| 1,583,695 | A | | 5/1926 | Lane | |
| 1,590,241 | A | * | 6/1926 | Grzeszkiewicz | 108/38 |
| 1,790,468 | A | * | 1/1931 | Frank et al. | 108/38 |
| 1,909,093 | A | * | 5/1933 | Buffelen | 108/39 |
| 2,157,675 | A | | 5/1939 | Rieter | |
| 2,646,634 | A | * | 7/1953 | Mongar | 108/39 |
| 2,963,804 | A | * | 12/1960 | Frechette | 108/39 |
| 3,170,417 | A | * | 2/1965 | Avidiya | 108/42 |
| 3,663,080 | A | * | 5/1972 | Ayers | 312/237 |
| 3,742,868 | A | | 7/1973 | Garceau et al. | |
| 3,965,588 | A | | 6/1976 | Long | |
| 4,862,811 | A | * | 9/1989 | Davis | 108/134 |
| 4,995,681 | A | * | 2/1991 | Parnell | 312/242 |
| 5,040,468 | A | * | 8/1991 | Miller et al. | 108/47 |
| 5,561,880 | A | * | 10/1996 | Allen et al. | 8/149.3 |
| 6,684,540 | B1 | | 2/2004 | Tufts | |
| 7,278,229 | B1 | | 10/2007 | Fen | |
| 8,381,552 | B2 | * | 2/2013 | Kendall et al. | 68/3 R |

FOREIGN PATENT DOCUMENTS

| | | |
|---|---|---|
| DE | 54428 | 1/1890 |

* cited by examiner

*Primary Examiner* — Ismael Izaguirre
(74) *Attorney, Agent, or Firm* — Gable Gotwals

(57) ABSTRACT

A wall mounted ironing board cabinet has a door on two-way sliders enabling cabinet "opened-to-the-right," "closed" and "opened-to-the-left" conditions. The sliding door and ironing board hardware afford a cabinet which maximizes the number of possible locations of the cabinet in a room, minimizes the depth of the protrusion of the closed cabinet into the room and renders the door outer surface adaptable to uses unrelated to the storage and support of an ironing board. The ironing board hardware also allows user selection of the ironing board surface level from multiple available intervals.

3 Claims, 5 Drawing Sheets

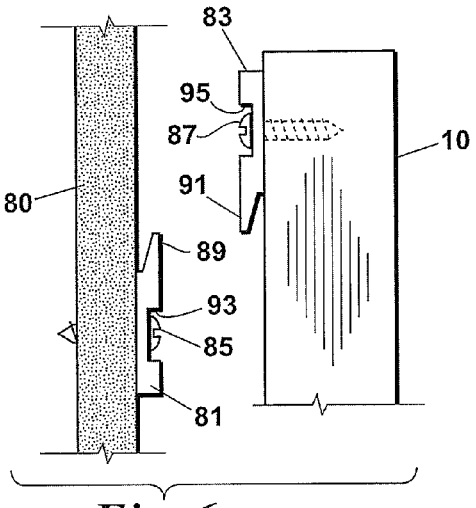
Fig. 6
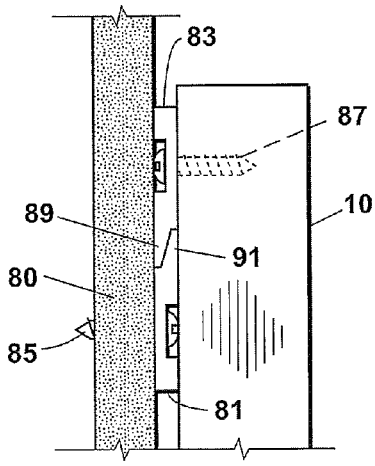
Fig. 7
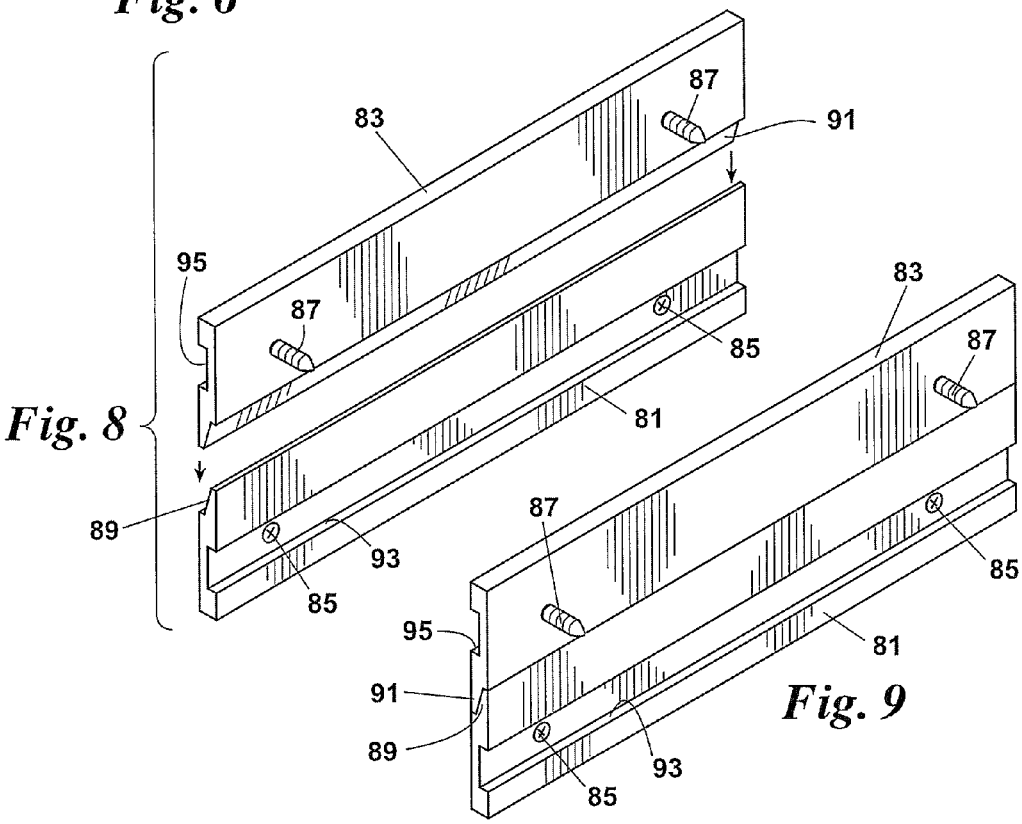
Fig. 8
Fig. 9

WALL MOUNTED IRONING BOARD CABINET

BACKGROUND OF THE INVENTION

This invention relates generally to ironing board cabinets and more particularly relates to wall mounted cabinets for concealing ironing boards in a vertical "storage" orientation and supporting them in a horizontal "use" orientation.

Earlier ironing boards had leg supports that could be folded. If sufficient space were available, a board might, for convenience sake, be left free-standing in an ironing area. More commonly, for space and/or aesthetic reasons, the legs would be folded after each use and the board leaned against a wall or stored in a closet. For older folks or for folks with physical debilitations, folding and carrying the boards can be problematic.

For some time now, ironing boards have been marketed which are self-contained in wall mounted cabinets with hinged doors. The doors conceal their presence when stored and the cabinets support them while they are in use. Wall mounted cabinets, which may be either surface mounted on or recessed in the wall with the cabinet door and surrounding finish trim overlapping the wall exterior surface, have become particularly popular in applications such as small apartments with limited living and storage space.

Whether they are surface mounted or recessed, wall mounted ironing board cabinets are typically at least as deep as a standard wall stud in order to accommodate the hardware and other structural components necessary to the folding out and support of the ironing board. The door, of course, extends forward of the cabinet in either case.

Use of these presently known ironing board cabinets is limited for a variety of reasons. For one, it is sometimes difficult in limited space conditions, especially if windows, entry doors, wall contours and wall decorations intrude on much of the existing wall space, to find a location suited to both swinging the cabinet door to the side and swinging the ironing board down to its "use" condition. For another, despite efforts to design cabinets as shallow as possible, the depth necessitated by the designs of known operating components of the cabinets still appears, in some applications, to be obtrusive and aesthetically unpleasant. Furthermore, because the doors of known ironing board cabinets swing, they may not make sufficient use of the valuable space they do occupy.

SUMMARY OF THE INVENTION

In accordance with the invention, a wall mounted ironing board cabinet is provided which has orthogonal top, bottom, side and back walls.

Mirror-image channels are routed in the lower inside surfaces of the side walls. The channels each have vertical passages spaced from the back wall and a vertical array of lateral passages which extend forwardly and upwardly from their respective vertical passage.

A door covers the open front of the cabinet. The door is attached to the cabinet by two-way sliders which permit the door to slide into and out of "cabinet opened to the right," "cabinet closed" and "cabinet opened to the left" conditions.

Pivot pins aligned on a common axis protrude laterally from the rear end of the ironing board. The pins are in sliding engagement in respective channels so that they can be moved into and out of any of the opposed lateral passages of the channels.

A linkage is pivotally connected at one end to the cabinet and at the other end to the underside of the ironing board. Preferably, the linkage has a rod pivotally connected at one of its ends to the cabinet and a cross rod fixed on its other end in a T-configuration. Opposed mirror image channels on the underside of the ironing board have a main passage parallel to the board and an array of transverse passages extending upwardly from the main passage toward the deck of the ironing board. The number of upwardly extending transverse passages on the board corresponds to the number of lateral passages on the cabinet. The cross rod of the linkage has its ends engaged to slide in the opposed channels on the ironing board and the transverse passages are spaced at intervals, the spacing of the transverse passages being coordinated with the spacing of respective lateral passages in which the pins are engaged so that, when the pins and rod are fully engaged in corresponding lateral and transverse passages, the board is maintained in a horizontal plane at the level of the engaged lateral passage.

When the ironing board has been rotated about the axis of the pins to its vertical "storage" orientation in the cabinet, the door can slide out of the "cabinet opened to the right" or "cabinet opened to the left" conditions into the "cabinet closed" condition for storage of the ironing board. When the door is slid into either the "cabinet opened to the right" or "cabinet opened to the left" conditions, the ironing board can be rotated about the axis of the pins into its horizontal "use" orientation at an elevation which will be determined by the level of that pair of the opposed lateral passages of the mirror-image channels in which the pins are engaged.

Because of the configuration of the cabinet, the door and the ironing board hardware, the number of possible locations of the cabinet in a room is maximized, the depth of the protrusion of the closed cabinet into the room is minimized and the door outer surface is adaptable to uses unrelated to the storage and support of an ironing board.

BRIEF DESCRIPTION OF THE DRAWINGS

Other objects and advantages of the invention will become apparent upon reading the following detailed description and upon reference to the drawings in which:

FIG. 6 is a side elevation view illustrating a rail mount assembly ready for mounting the ironing board cabinet on the wall;

FIG. 7 is a side elevation view illustrating the rail mount assembly of FIG. 6 with the ironing board cabinet mounted on the wall;

FIG. 8 is an exploded perspective view of the rails of the rail mount assembly in position for engagement with each other;

FIG. 9 is an exploded perspective view of the rails of the rail mount assembly engaged with each other.

Figure 3:
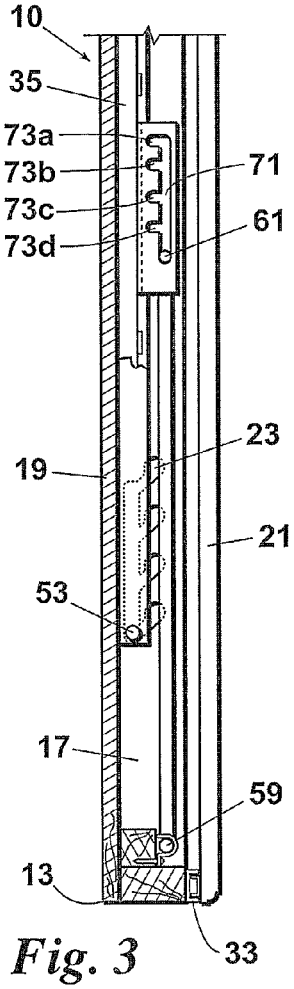
FIG. 3 is a cross-sectional view taken along the line 3-3 of FIG. 1.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Turning first to FIGS. 1-4, a shallow, wall mounted ironing board cabinet 10 is illustrated. The cabinet 10 has orthogonal top 11, bottom 13, side 15 and 17 and back 19 walls and a door 21 covering the open front of the cabinet 10.

Figure 2:
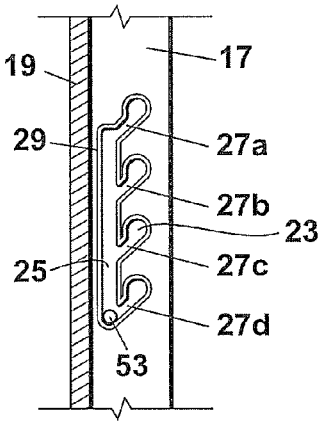
FIG. 2 is a cross-sectional view taken along the line 2-2 of FIG. 1.
Figure 10:
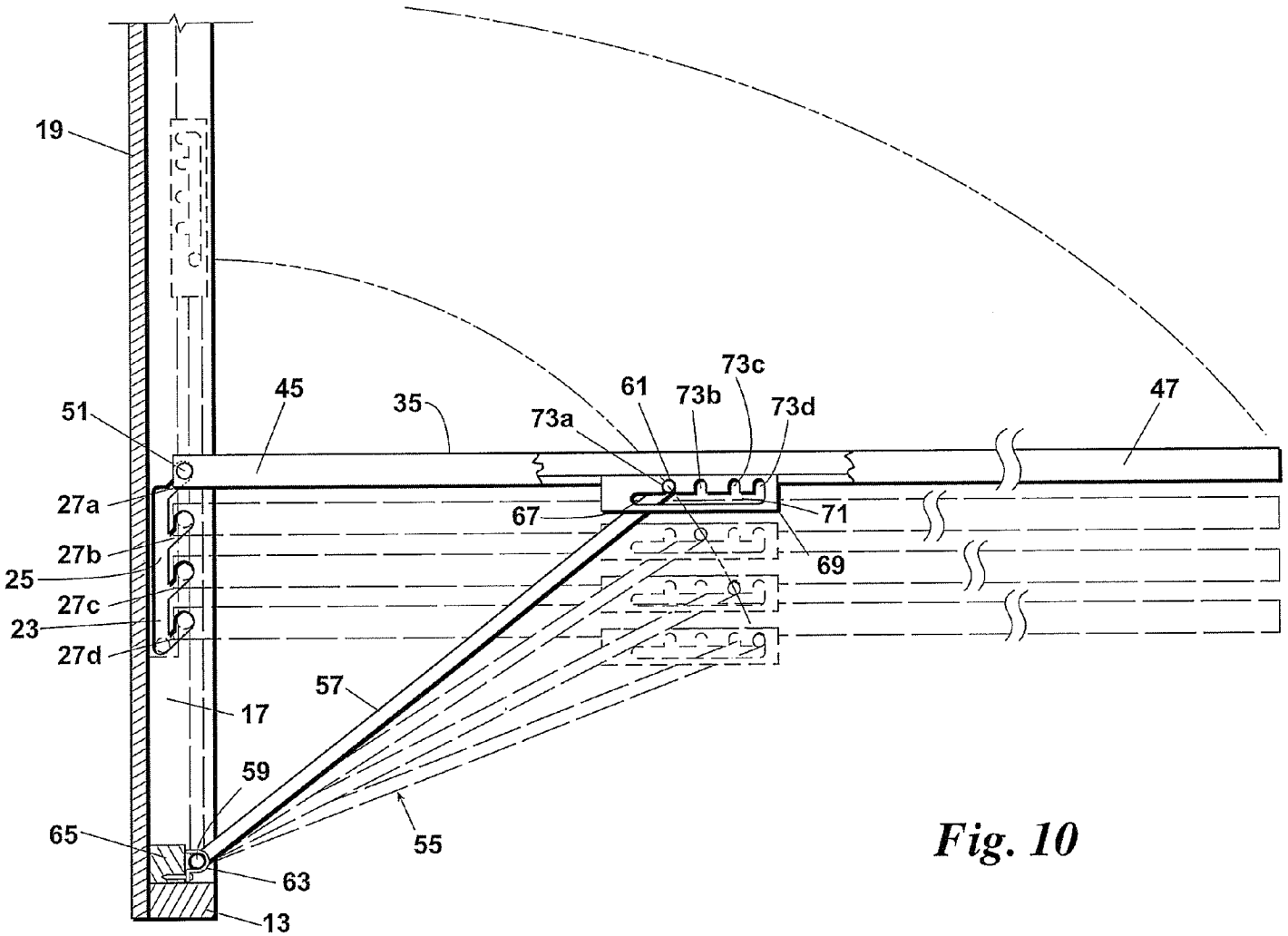
FIG. 10 is a cross-sectional view illustrating the transition of the ironing board between its vertical "storage" orientation and four selectable horizontal "use" orientations.

As seen in FIGS. 2, 3 and 10, a pair of mirror-image channels 23 are routed in the opposed lower inside surfaces of their respective cabinet side walls 15 and 17. Each of the channels 23 has a vertical passage 25 spaced from the cabinet back wall 19 with an array of lateral passages $\mathbf{27}_a$, $\mathbf{27}_b$, $\mathbf{27}_c$ and $\mathbf{27}_d$ which extend forwardly and upwardly from their respective vertical passage 25. Preferably, the walls of the vertical 25 and lateral 27 passages of each channel 23 will be protected by a thin plastic insert 29.

Figure 1:
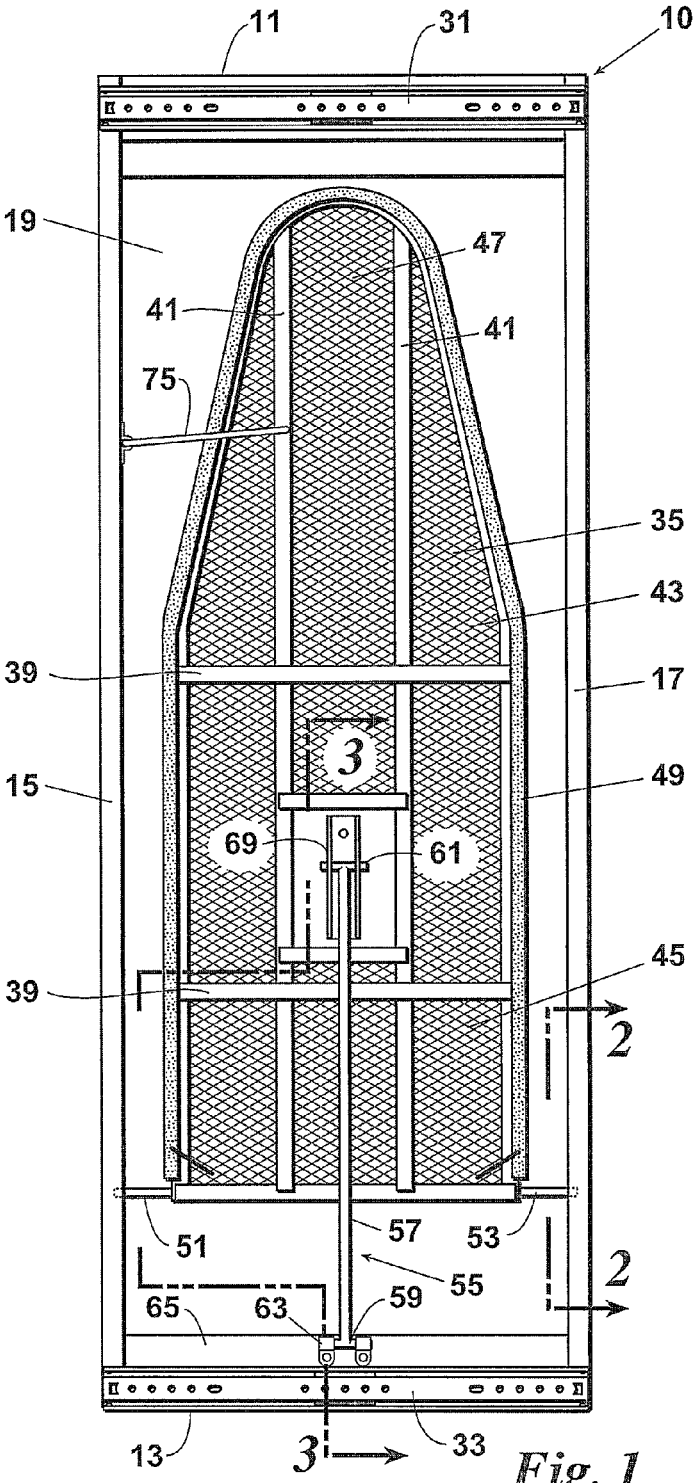
FIG. 1 is a front elevation view of the wall mounted ironing board cabinet with the cabinet door removed.

Looking at FIGS. 1 and 3, the door 21 is attached to the front faces of the top 11 and bottom 13 walls of the cabinet 10 by upper 31 and lower 33 two-way sliders. The sliders 31 and 33 permit the door 21 to slide laterally across the front of the cabinet 10 from a "cabinet-closed" condition into a "cabinet-opened-to-the-left" condition seen in FIG. 4 or a "cabinet-opened-to-the-right" condition seen in FIG. 5.

Figure 4:
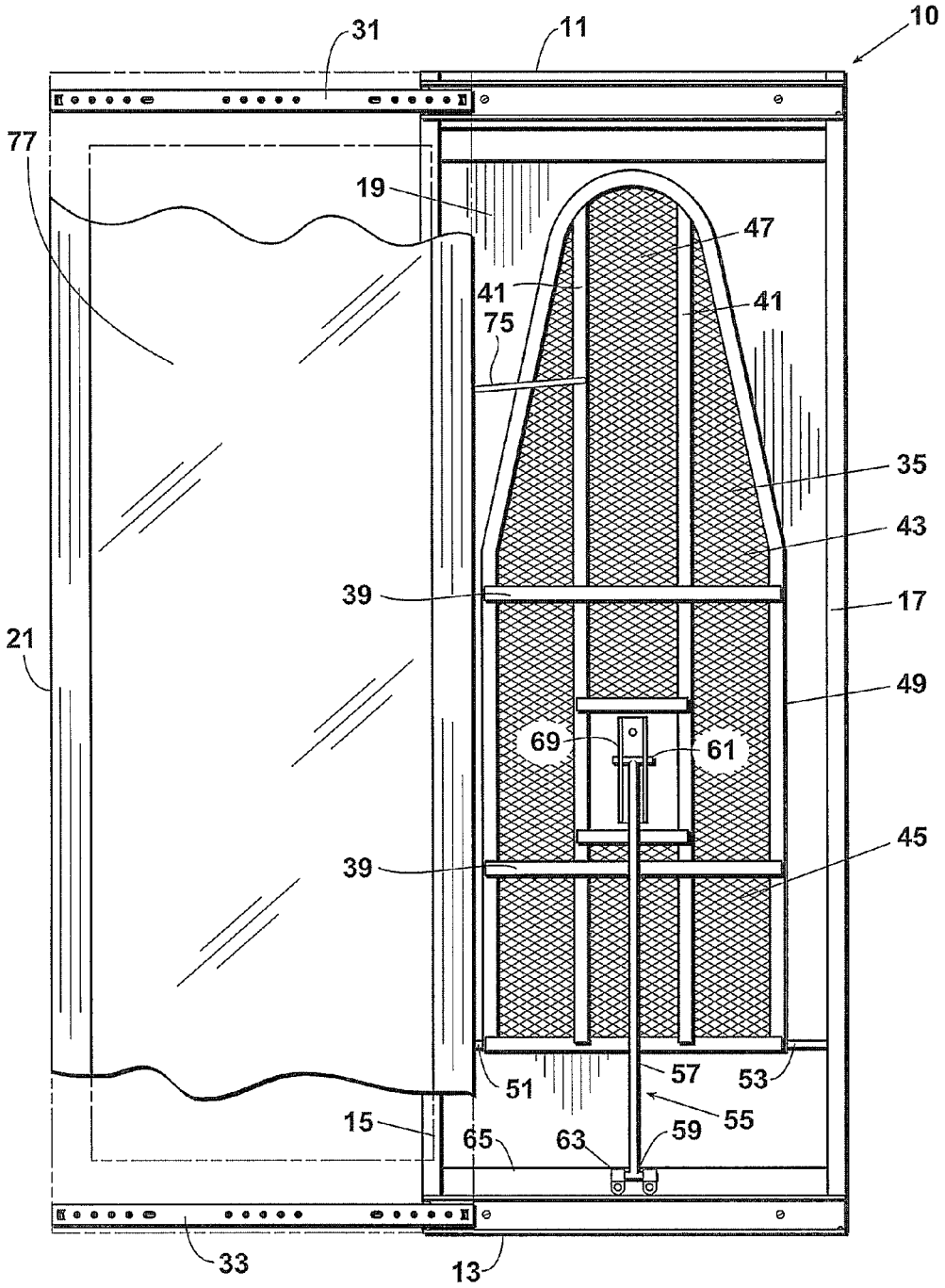
FIG. 4 is a front elevation view with parts broken away of the wall mounted ironing board cabinet with a mirrored surface cabinet door in its "opened to the left" condition and the ironing board in its vertical "storage" orientation.
Figure 5:
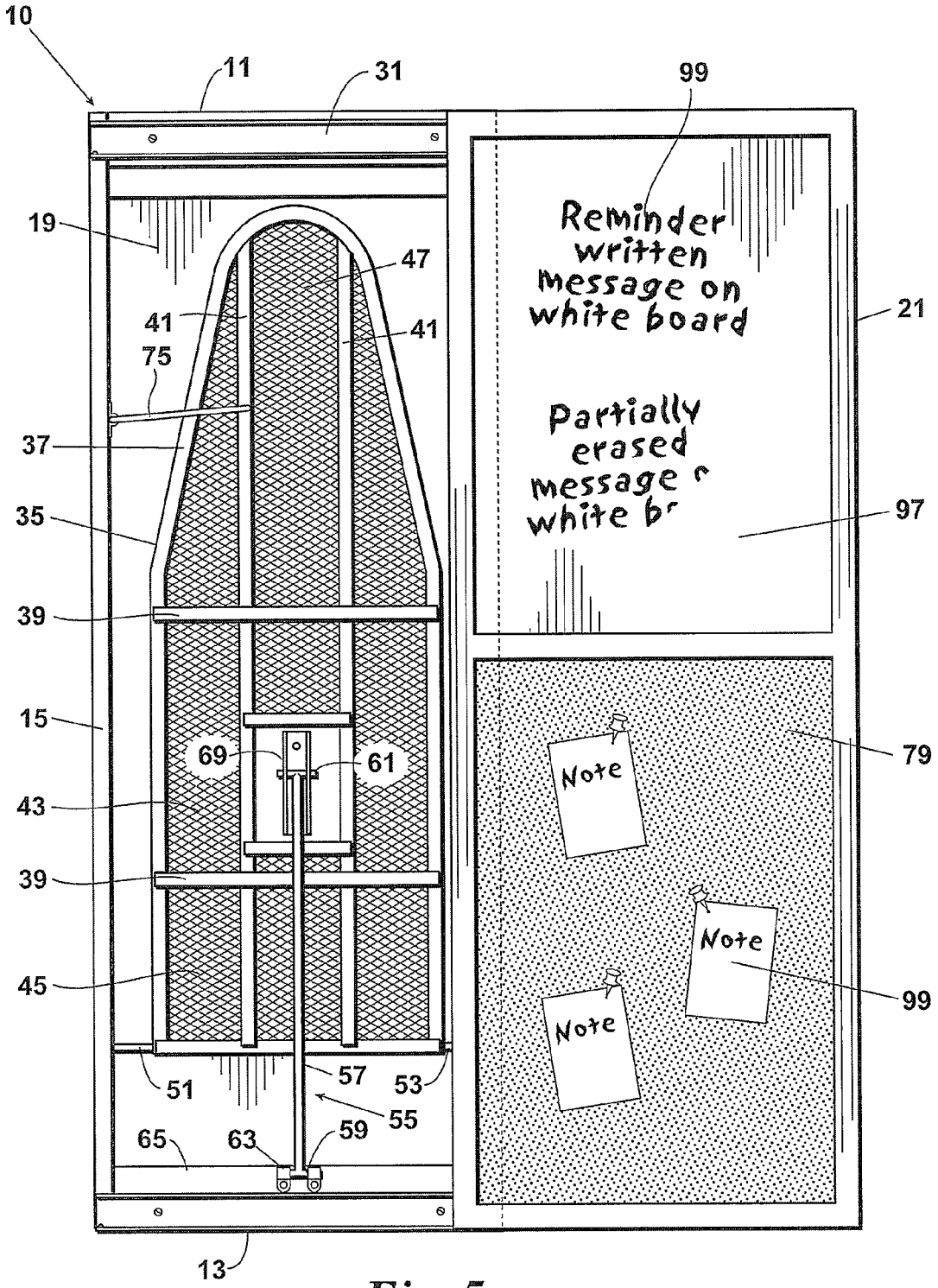
FIG. 5 is a front elevation view of the wall mounted ironing board cabinet with a half white board/half cork board surface cabinet door in the "opened to the right" condition and the ironing board in its vertical "storage" orientation.

As seen in FIGS. 1, 4 and 5, the ironing board 35 is formed with a metal tube perimeter 37 reinforced by widthwise 39 and lengthwise 41 metal tubes and is covered by a metal grid or wire deck 43. The board 35 has a rectangular ironing surface at its back end 45 and a tapered ironing surface at its front end 47. As best seen in FIG. 1, the entire top surface of the deck 43 may be covered by an ironing board cover 49 which wraps around and under the side and front tube portions of the perimeter 37 of the board 35.

Looking at FIGS. 1-5 and 10, a pair of pivot pins 51 and 53 aligned on a common axis extend laterally outwardly from the back end 45 of the ironing board 35. The pins 51 and 53 have a diameter such as to permit sliding engagement of the pins 51 and 53 within the channels 23.

Continuing to look at FIGS. 1, 3-5 and 10, a linkage 55 is pivotally connected between the ironing board 35 and the cabinet 10. The linkage 55 includes an elongated rod 57 ending at shorter cross rods 59 and 61. One cross rod 59 is pivotally attached at one end to a bracket 63 mounted on the cabinet 10 near the joint of the bottom 13 and back 19 walls of the cabinet 10, as shown to a bracing member 65 provided for this purpose. The other cross rod 61 is engaged to slide in opposed mirror-image channels 67 in a bracket 69 fixed to the underside of the central portion of the ironing board 35. As best seen in FIGS. 3 and 10, the channels 67 have a main passage 71 parallel to the board 35 and an array of transverse passages $\mathbf{73}_a$, $\mathbf{73}_b$, $\mathbf{73}_e$ and $\mathbf{73}_d$ extending upwardly from the main passage 71 toward the ironing board deck 43. The number of transverse passages 73 in the ironing board channels 67 corresponds to the number of lateral passages 27 in the cabinet side walls 15 and 17, as shown, four, but at least one and as many as four or more. Preferably, the lateral passages 27 are equally vertically spaced, perhaps on 2" centers, and the transverse passages 73 are displaced at corresponding intervals in terms of board orientation, as hereinafter explained.

As seen in FIGS. 1,4 and 5, in operation, when the ironing board 35 is rotated about the axis of the pins 51 and 53 to its vertical "storage" orientation in the cabinet 10, a latch 75 on the upper inside portion of one of the cabinet side walls 15 can be rotated to secure the ironing board 35 in its vertical "storage" orientation. The door 21 can then be slid out of the "cabinet-opened-to-the-left" condition shown in FIG. 4 or the "cabinet-opened-to-the-right" condition shown in FIG. 5 into the "cabinet-closed" condition.

Turning to FIG. 10, when the door 21 is slid into either the "cabinet-opened-to-the-left" or "cabinet-opened-to-the-right" condition, the ironing board 35 can be rotated about the axis of the pins 51 and 53 into its horizontal "use" orientation. The elevation of the board 35 in its horizontal "use" orientation is determined by the level of the pair of opposed lateral passages 27 of the cabinet 10 into which the pins 51 and 53 on the back end 45 of the board 35 are slid. The intervals between the transverse passages 73 at the central portion of the underside of the board 35 are coordinated with the spacing of the lateral passages 27 on the cabinet 10 so that, when the board side cross rod 61 of the linkage 55 is engaged in the transverse passage 73 which corresponds to the lateral passage 27 in which the pins 51 and 53 are engaged, the board 35 is maintained in its horizontal "use" orientation. As shown, the pins 51 and 53 are engaged in the uppermost lateral passages $\mathbf{27}_a$ of the cabinet side walls 15 and 17 and the board 21 is at its highest horizontal level when the cross rod 61 is engaged in the proximal transverse passage 73, of the board bracket 69. Corresponding cooperation of lateral passages $\mathbf{27}_b$, $\mathbf{27}_c$ and $\mathbf{27}_d$ with transverse passages $\mathbf{73}_b$, $\mathbf{73}_c$ and $\mathbf{73}_d$, respectively, will result in sequentially lower horizontal levels of the ironing board 21.

In returning the board 21 to its vertical "storage" orientation, the board 21 is lifted to disengage the cross rod 61 from the transverse passages $\mathbf{73}_a$ and allow the cross rod 61 to be seated at the proximal end of the main passage 71. As the board 35 is further lifted, the pins 51 and 53 will disengage from the lateral passages $\mathbf{27}_a$ and slide to the bottom of the vertical passages 25, at which point the board 35 will have been returned to the vertical "storage" orientation.

As an alternative to the above described fixed length linkage 55, a telescoping linkage (not shown) may be used in which the exposed end of a rod extending from a tube is pivotally attached to a bracket recessed in the central underside portion of the ironing board 35 and the opposite end of the tube is pivotally attached to a bracket mounted on the cabinet 10 near the joint of the bottom 13 and back 19 walls of the cabinet 10. With the pins 51 and 53 on the board 35 engaged in opposite lateral passages, the board 35 is rotated to its horizontal "use" orientation, the linkage telescoping accordingly. Once the board 35 is horizontal, a set screw or the like can be tightened to fix the length of the linkage and secure the board 35 in the horizontal "use" orientation. To return the board 35 to the "storage" orientation, the set screw is loosened and, as the board 35 is lifted, the pins 51 and 53 slide out of the lateral passages 73 into their respective vertical passages 25. When the pins 51 and 53 reach the bottom of their vertical passages, the board 35 is in the vertical "storage" orientation.

Looking at FIG. 1, the total depth of the cabinet 10 is only slightly more than the thicknesses of the back wall 19, the ironing board 35 and linkage bracket 69 and the door 21. As seen in FIGS. 6-9, the cabinet 10 can preferably be mounted on the wall 80 by a pair of horizontal rails 81 and 83, the lower rail 81 being fastened to the wall 80 by screws 85 and the upper rail 83 being fastened to the cabinet 10 by screws 87. The rails 81 and 83 have complementary tongues 89 and 91, respectively, so that, as the upper rail 83 slides down the surface of the wall 80, the upper rail tongue 91 engages between the lower tongue 89 and the wall as the lower rail tongue 89 engages between the upper tongue 91 and the cabinet back wall 19. The heads of the screws 83 and 85 are seated in recesses 93 and 95 in the lower and upper rails 81 and 83, respectively.

The outer surface of the sliding door 21 can be laminated with a mirror 77, as shown in full length in FIG. 4, a sheet of cork-board 79 or white board 97, as shown half and half in FIG. 5, or simply be solid, as shown in FIG. 3. Since the door 21 slides rather than rotates, the surface of the mirror 77 and any messaging 99 on the cork board 79 or white board 97 will always be visible and/or functional regardless of the whether the door 21 is in an opened or closed condition.

Thus, it is apparent that there has been provided, in accordance with the invention, a wall mounted ironing board cabinet that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit of the appended claims.

What is claimed is:

1. A wall mounted ironing board comprising:

an orthogonal cabinet having top, bottom, side and back walls, said side walls having mirror-image channels in lower inside surfaces thereof, each said channel having a vertical passage spaced from said back wall and having a vertical array of lateral passages, each of said lateral passages extending forwardly and upwardly from its respective one of said vertical passages;

a door covering an open front of, and attached by two-way sliders to, said cabinet, said sliders permitting said door to slide into and out of any of "cabinet-opened-to-the-right," "cabinet-closed" and "cabinet-opened-to-the-left" conditions;

an ironing board having pivot pins aligned on a common axis, each said pin protruding laterally from its respective side of a rear end of said ironing board for sliding engagement in said channels; and a linkage connected at one end thereof to said cabinet and at another end thereof to an underside of said ironing board;

whereby, when said ironing board is rotated about said axis of said pins to a vertical "storage" orientation in said cabinet, said door can slide out of said "cabinet-opened-to-the-right" and "cabinet-opened-to-the-left" conditions into said "cabinet-closed" condition and, when said door is slid into one of said "cabinet-opened-to-the-right" and "cabinet-opened-to-the-left" conditions, said ironing board can rotate about said axis of said pins into a horizontal "use" orientation, an elevation of said board being a level of that pair of said opposed lateral passages of said cabinet into which said pins are slid, said linkage being operable to maintain and release said board in and from said horizontal "use" orientation.

2. A wall mounted ironing board comprising:

an orthogonal cabinet having top, bottom, side and back walls, said side walls having mirror-image channels in lower inside surfaces thereof, each said channel having a vertical passage spaced from said back wall and having a vertical array of lateral passages, each of said lateral passages extending forwardly and upwardly from its respective one of said vertical passages;

a door covering an open front of, and attached by two-way sliders to, said cabinet, said sliders permitting said door to slide into and out of any of "cabinet-opened-to-the-right," "cabinet-closed" and "cabinet-opened-to-the-left" conditions;

an ironing board having pivot pins aligned on a common axis, each said pin protruding laterally from its respective side of a rear end of said ironing board for sliding engagement in said channels; and a linkage connected at one end thereof to said cabinet and at another end thereof to an underside of said ironing board, said linkage comprising:

opposed mirror-image channels on said underside of said ironing board, said channels having a main passage parallel to said board and an array of transverse passages extending from said main passage toward a deck of said ironing board, a number of transverse passages in said ironing board channels corresponding to a number of lateral passages in said cabinet side wall channels; and a rod pivotally connected at one end thereof to said cabinet and having at another end thereof a cross rod in T-configuration, ends of said cross rod being engaged to slide in said opposed mirror-image channels;

said transverse passages being at intervals graduated to coordinate with said lateral passages so that said board is maintained in said horizontal "use" orientation when said cross rod of said linkage is engaged in that one of said transverse passages which corresponds to that one of said lateral passages in which said pins are engaged;

whereby, when said ironing board is rotated about said axis of said pins to a vertical "storage" orientation in said cabinet, said door can slide out of said "cabinet-opened-to-the-right" and "cabinet-opened-to-the-left" conditions into said "cabinet-closed" condition and, when said door is slid into one of said "cabinet-opened-to-the-right" and "cabinet-opened-to-the-left" conditions, said ironing board can rotate about said axis of said pins into a horizontal "use" orientation, an elevation of said board being a level of that pair of said opposed lateral passages of said cabinet into which said pins are slid, said linkage being operable to maintain and release said board in and from said horizontal "use" orientation.

3. A wall mounted ironing board comprising:

an orthogonal cabinet having mirror-image channels in lower inside surfaces of opposite side walls thereof, each said channel having a vertical passage and a vertical array of lateral passages, each of said lateral passages extending forwardly and upwardly from its respective one of said vertical passages;

a door covering an open front of said cabinet;

an ironing board having pivot pins aligned on a common axis, each said pin protruding laterally from its respective side of a rear end of said ironing board for sliding engagement in said channels;

opposed mirror-image channels on said underside of said ironing board, said channels having a main passage parallel to said board and an array of transverse passages extending from said main passage toward a deck of said ironing board, a number of transverse passages in said ironing board channels corresponding to a number of aid lateral passages in said opposed cabinet side wall channels; and a rod pivotally connected at one end thereof to said cabinet and having at another end thereof a cross rod in T-configuration, ends of said cross rod being engaged to slide in said opposed mirror-image channels;

said transverse passages being at intervals graduated to coordinate with said lateral passages so that said board is maintained in a horizontal "use" orientation when said cross rod is engaged in that one of said transverse passages which corresponds to that one of said lateral passages in which said pins are engaged.

* * * * *